US009981676B2

(12) United States Patent
Sandstrom

(10) Patent No.: US 9,981,676 B2
(45) Date of Patent: May 29, 2018

(54) DERAIL ALARM SYSTEMS

(71) Applicant: Edward Stanton Sandstrom, Langley (CA)

(72) Inventor: Edward Stanton Sandstrom, Langley (CA)

( * ) Notice: Subject to any disclaimer, the term of this patent is extended or adjusted under 35 U.S.C. 154(b) by 252 days.

(21) Appl. No.: 14/996,223

(22) Filed: Jan. 15, 2016

(65) Prior Publication Data

US 2017/0203777 A1 Jul. 20, 2017

(51) Int. Cl.

| | |
|---|---|
| ***B61L 99/00*** | (2006.01) |
| ***B61K 9/00*** | (2006.01) |
| ***E01B 35/04*** | (2006.01) |
| ***E01B 27/20*** | (2006.01) |

(52) U.S. Cl.

CPC ..... *B61L 99/00* (2013.01); *B61K 9/00* (2013.01); *E01B 27/20* (2013.01); *E01B 35/04* (2013.01); *E01B 2203/12* (2013.01); *E01B 2203/16* (2013.01)

(58) Field of Classification Search

CPC ..... E01B 29/00; E01B 29/04; E01B 31/00; E01B 31/02; E01B 35/00; E01B 35/02; E01B 35/04; E01B 35/06; E01B 35/12

See application file for complete search history.

(56) References Cited

U.S. PATENT DOCUMENTS

| | | | | |
|---|---|---|---|---|
| 2,832,148 | A | 4/1953 | Rousse | |
| 3,144,834 | A | 6/1961 | John | |
| 3,270,690 | A | 6/1962 | Applegate et al. | |
| 4,452,146 | A | 6/1984 | Bradshaw et al. | |
| 6,546,876 | B2 | 4/2003 | Theurer et al. | |
| 2006/0032063 | A1 | 2/2006 | Tomasello et al. | |
| 2013/0030685 | A1 | 1/2013 | Goetting | |
| 2015/0083013 | A1* | 3/2015 | Carney | E01B 35/00 104/7.1 |

FOREIGN PATENT DOCUMENTS

| | | |
|---|---|---|
| CA | 2865093 | 9/2013 |

* cited by examiner

*Primary Examiner* — Robert J McCarry, Jr.

(74) *Attorney, Agent, or Firm* — Integrity Patent Group, PLC; Edwin Wold

(57) ABSTRACT

A derail alarm system for notifying a tamping machine operator that a tamping projector buggy is in a derailed condition. A rail sensor with an ultrasonic beam attaches to a tamping projector buggy to sense alignment with a metal rail. When the ultrasonic sensor detects an out-of-tolerance condition, aural and red-LED light visual indications are electronically provided to the tamping machine operator. The tamping machine operator may disable the aural indication and change the red-LED indication to an amber-LED indication until the ultrasonic sensor detects an in-tolerance condition. A limit switch deactivates the cradle sensor when the tamping projector buggy is raised and stored in the travel position for a higher speed transport condition.

17 Claims, 5 Drawing Sheets

DERAIL ALARM SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of system disengagement notification means and more specifically relates to a derail alarm system.

2. Description of Related Art

Railway systems consist of metal rails, concrete or wood railroad ties, and a bed of crushed stone, called ballast. Although fixed in appearance, railway systems are dynamic and deform due to the forces created when a train travels over the metal rails. The metal rails generally return to their original position after a train passes. Over time, however, the metal rails shift and if they shift enough, railway operators are required to implement temporary speed restrictions, until the metal rails are restored to their original position. As a result, railway systems are maintained by applying leveling, lifting, lining, and tamping forces in the ballast until the metal rails and railroad ties are returned to their proper positions.

A tamping machine accomplishes the maintenance required to align the metal rails. A component of this machine, called a tamping projector buggy is used to project beams of light to receivers located on the tamping machine and enable the computer program and the operator to assess the variation in the metal rail alignment and make any changes necessary to the lift, alignment or tamping cycle to achieve the desired results. The tamping projector buggy is connected to the tamping machine via a pushing mechanism which may variably push the tamping projector buggy 40-100 feet ahead of the tamping machine, depending on the needs of the tamping machine operator and the general railway system environment. When compared to the weight of the tamping machine, the tamping projector buggy is considered to be very lightweight.

It is critical for the tamping projector buggy to maintain correct positioning with the metal rails to properly assess the condition of the metal rails. Due to the lightweight nature of the tamping projector buggy, it can be derailed by ballast, which may be pushed up against the metal rails, or pushed on top of the metal rails. The tamping projector buggy may also be derailed by moving through rail-switches, or by moving against broken, worn or damaged rails. In addition, transporting a tamping machine and tamping projector buggy to various work locations may require the machine and tamping projector buggy to travel at normal railway system speeds whereas bumps or misalignments of the metal rails can derail the tamping projector buggy.

When a tamping projector buggy is derailed, it can be damaged, which may require costly repairs. Also, when operating in a derailed condition, the information fed to the tamping machine may be incorrect, resulting in bad, or incomplete alignment of the metal rails. No tamping projector buggies presently have a means to notify a tamping machine operator that the tamping projector buggy is in a derailed condition. A suitable solution is desired.

Several attempts have been made to solve the above-mentioned problems such as those found in U.S. Pat. and Pub. Nos. 2006/0032063 to Tomasello et. al.; 2013/0030685 to Goetting; 2015/0083013 to Carney; U.S. Pat. No. 3,270,690 to Applegate et. al.; U.S. Pat. No. 6,546,876 to Theurer et. al.; U.S. Pat. No. 3,144,834 to John; U.S. Pat. No. 2,832,148 to Rousse; U.S. Pat. No. 4,452,146 to Bradshaw et. al.; and CA Pat No. 2,865,093 to Spence. This art is representative of system disengagement notification means. However, none of the above inventions and patents, taken either singly or in combination, is seen to describe the invention as claimed.

Preferably, the derail alarm system should provide a signaling means to an operator when a tamping projector buggy has derailed, and, yet would operate reliably and be manufactured at a modest expense. Thus, a need exists for a reliable derail alarm system to avoid the above-mentioned problems.

BRIEF SUMMARY OF THE INVENTION

In view of the foregoing disadvantages inherent in the known system disengagement notification means art, the present invention provides a novel derail alarm system. The general purpose of the present invention, which will be described subsequently in greater detail is to provide a means for signaling an operator when a tamping projector buggy has derailed.

A derail alarm system is disclosed herein in a preferred embodiment comprising a rail sensor, a cradle sensor, and a control box. The rail sensor is structured and arranged to provide an ultrasonic beam, a first-preset tolerance, an electronic signaling means, and a mounting bracket. The ultrasonic beam may be positioned perpendicular to the rail sensor. The first-preset tolerance may comprise a first-preset tolerance of 4-8 inches for the ultrasonic beam. When the first-preset tolerance exceeds 4-8 inches, the electronic signaling means activates the control box indications. Other tolerance values may be used. Further, the mounting bracket may comprise an attacher to affix the rail sensor to a tamping projector buggy.

The control box may comprise an electronic signal receiver, an illuminated notification device, an aural (audible) notification means, a system reset means, and a system acknowledgement device. The illuminated notification device may comprise at least three LED lights. The at least three LED lights may comprise at least two red-LED lights and at least one amber-LED light in preferred embodiments. The electronic signaling means illuminates the at least two red-LED lights when the first-preset tolerance of the ultrasonic beam is exceeded. Other colors of LEDs may be used. The electronic signaling means also simultaneously activates the aural notification means when the first-preset tolerance of the ultrasonic beam is exceeded. Generally speaking, the aural notification means may comprise a variable tone of at least 95 dB to enable the operator to hear the aural notification in the working environment.

The system acknowledgement device may comprise a disablement-means to temporarily disable the aural notification means. The system acknowledgement device may comprise a switch to allow an operator to silence the aural notification means. When the aural notification means is disabled, the system acknowledgement device illuminates the at least one amber LED light. The electronic signaling means removes signals to the at least two red-LED lights and the aural notification means when the first-preset tolerance of the ultrasonic beam is within limits. Further, the system reset means may comprise a switch to allow an operator to electronically signal the rail sensor to revert to an in-tolerance condition for the first-preset tolerance. Those with ordinary skill in the art will now appreciate that upon reading this specification and by their understanding the art of ultrasonic beams, preset tolerances, electronic signaling means, and controllers as described herein, methods of measurement and communication will be understood by those knowledgeable in such art.

The cradle sensor may comprise a limit switch which may be adjusted turn off the voltage to the sensor when the projector buggy is stored on the cradle and the cradle is raised above the 4-8 inch sensor tolerance and secured to the travel position. Other tolerance values may be used. When the limit switch is activated, the limit switch of the cradle sensor may comprise a means to disengage the rail sensor. Activation of the limit switch may allow transport of the tamping projector buggy without enabling the electronic signaling means. In this way the present invention is user-friendly.

The derail alarm systems may be useful for providing an electronic signal to the illuminated notification device and the aural notification means when the first-preset tolerance of the rail sensor is exceeded to notify of a derailment. The derail alarm system further may comprise a kit including the rail sensor, the cradle sensor, the control box, and a set of user instructions. A method of using a derail alarm system may comprise the steps of: attaching a rail sensor, attaching a cradle sensor, installing a control box, and operating a derail alarm assembly.

The present invention holds significant improvements and serves as a derail alarm system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, derail alarm systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a system disengagement notification means and more particularly to a derail alarm system as used to improve signaling efficiency to an operator when a tamping projector buggy has derailed.

Generally speaking, the derail alarm system resembles a derail alarm assembly for notifying a tamping machine operator that a tamping projector buggy is in a derailed condition, as previously mentioned. A rail sensor with an ultrasonic beam attaches to a tamping projector buggy to sense alignment with a metal rail. When the ultrasonic sensor detects an out-of-tolerance condition, aural and red-LED light visual indications are electronically provided to the tamping machine operator. The tamping machine operator may disable the aural indication and change the red-LED indication to an amber-LED indication until the ultrasonic sensor detects an in-tolerance condition. A cradle sensor contains a limit switch to deactivate the cradle sensor when the tamping projector buggy is raised and stored in the travel position for a higher speed transport condition. Other arrangements allow use of the rail sensor in an independent installation from the cradle sensor.

Figure 1:
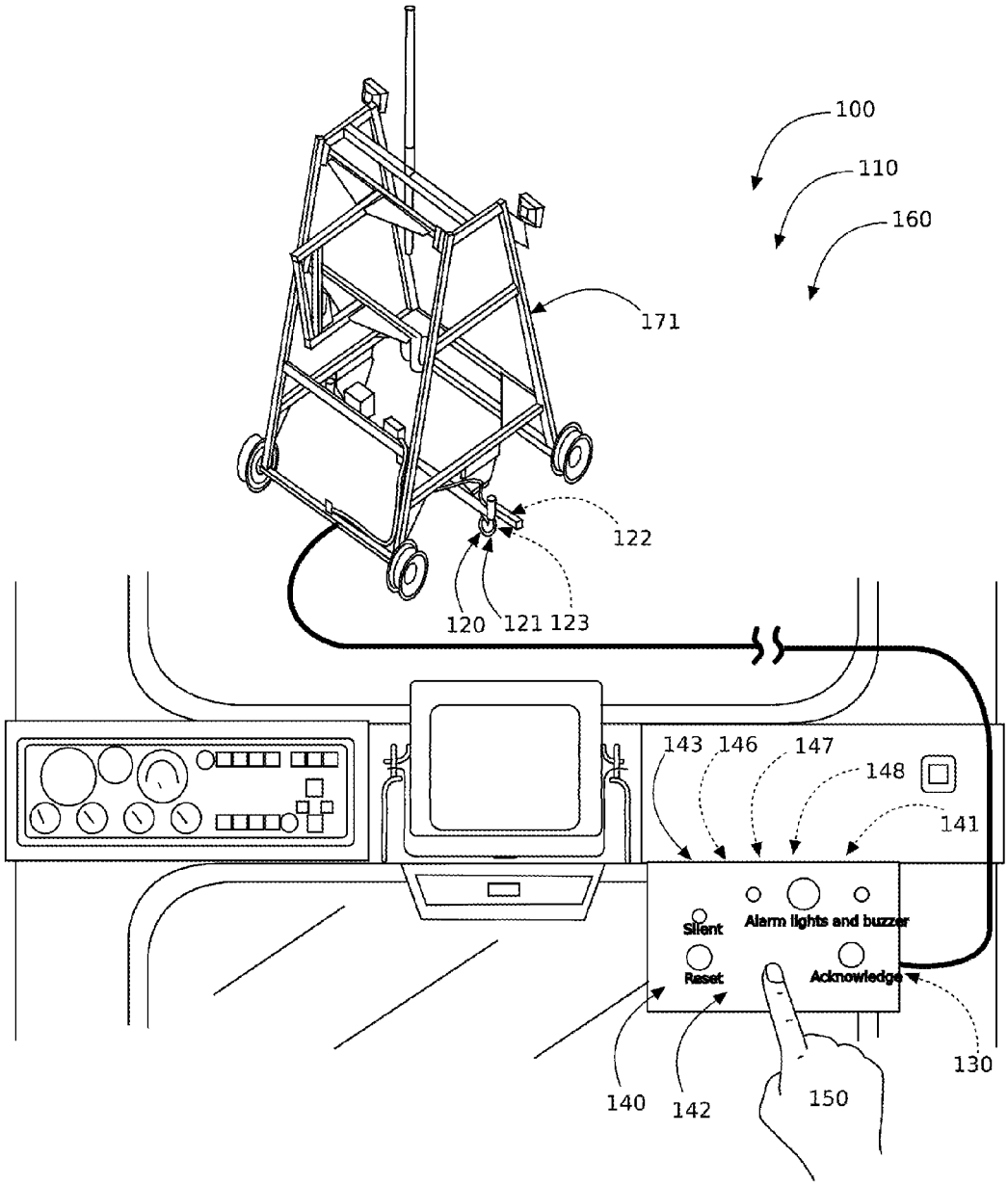
FIG. 1 shows a perspective view illustrating a derail alarm system during an 'in-use' condition showing the derail alarm system according to an embodiment of the present invention.

Referring to the drawings by numerals of reference there is shown in FIG. 1, derail alarm system 100 in 'in-use' condition 160, comprising in structural combination rail sensor 120, cradle sensor 130, and control box 140 to determine if tamping projector buggy 171 is in alignment. Derail alarm assembly 110 is useful for providing electronic signaling means 123 to illuminated notification device 142, and aural notification means 143 when first-preset tolerance 122 of rail sensor 120 is exceeded, thus notifying user 150 of a derailed tamping projector buggy 171. Rail sensor 120 is structured and arranged to provide ultrasonic beam 121, first-preset tolerance 122, and electronic signaling means 123. Other sensing arrangements, such as radar, magnetic, laser, and radio frequency, etc., may be sufficient. Further, ultrasonic beam 121 may be positioned perpendicular to rail sensor 120. Preferably first-preset tolerance 122 may comprise 4-8 inches for ultrasonic beam 121. Other tolerances may be used as per intended application. When the tolerance exceeds first-preset tolerance 122 of 4-8 inches, electronic signaling means 123 activates control box 140 indications.

In continuing to refer to FIG. 1, control box 140 may comprise electronic signal receiver 141, illuminated notification device 142, and aural notification means 143. Generally speaking, aural notification means 143 may comprise constant tone 146 or variable tone 147. Aural notification means 143 may further be comprise volume of at least 95 dB 148 to enable the operator to hear the aural notification in the working environment.

Figure 2:
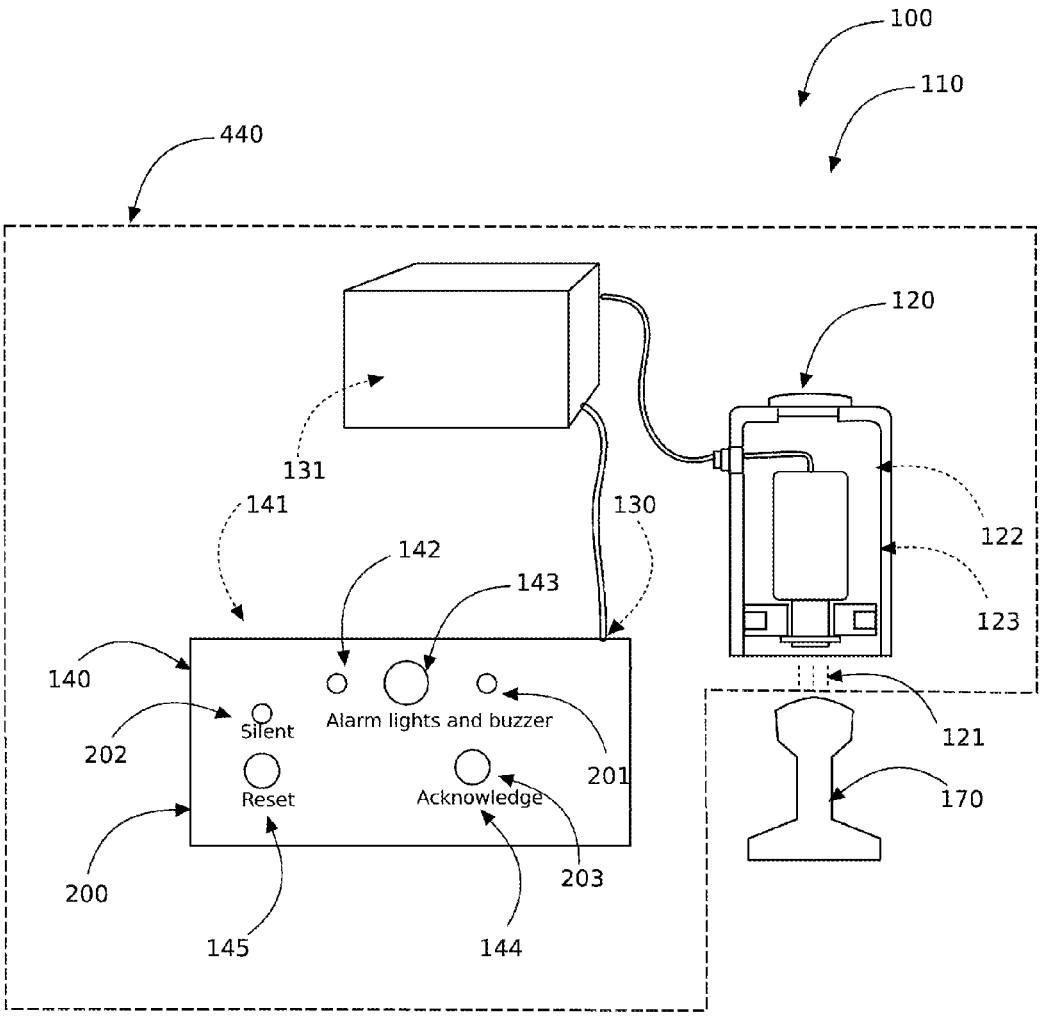
FIG. 2 is an exploded view illustrating the derail alarm system comprising a derail alarm assembly according to an embodiment of the present invention of FIG. 1.

Referring now to FIG. 2, showing an exploded view of derail alarm system 100 which may comprise kit 440. Derail alarm system 100 may comprise rail sensor 120 positioned over metal rail 170, cradle sensor 130, and control box 140. Rail sensor 120 may comprise ultrasonic beam 121, first-preset tolerance 122, and electronic signaling means 123. Further, ultrasonic beam 121 may be positioned perpendicular to rail sensor 120. Other orientations may be employed.

First-preset tolerance 122 may comprise a limit of 4-8 inches for the ultrasonic beam 121. When first-preset tolerance 122 exceeds 4-8 inches in preferred embodiments, electronic signaling means 123 activates control box 140 indications.

In referring further to FIG. 2, cradle sensor 130 may comprise limit switch 131. Limit switch 131 of cradle sensor 130 may comprise a means to disengage rail sensor 120 when limit switch 131 is activated. Limit switch 131 of cradle sensor 130 may comprise a disabler to deactivate cradle sensor 130 when tamping projector buggy is raised and stored in a travel position. Other activating arrangements such as a switch, a touch screen, self-contained DC electrical power, ON/OFF switch etc., may be sufficient.

In continuing to refer to FIG. 2, control box 140 may comprise electronic signal receiver 141, illuminated notification device 142, aural notification means 143, system acknowledgement device 144, and system reset means 145. Illuminated notification device 142 may comprise at least three LED lights 200. The at least three LED lights 200 may comprise at least two red-LED lights 201, and at least one amber-LED light 202. Other colors of LEDs or other such suitable illumination means may be used. Electronic signaling means 123 illuminates at least two red-LED lights 201 when first-preset tolerance 122 of ultrasonic beam 121 is exceeded. Electronic signaling means 123 simultaneously activates aural notification means 143 when first-preset tolerance 122 of ultrasonic beam 121 is exceeded. Electronic signaling means 123 removes signals to at least two red-LED lights 201 and aural notification means when first-preset tolerance 122 of ultrasonic beam 121 is within limits.

System acknowledgement device 144 may comprise disablement-means to temporarily disable aural notification means 143. System acknowledgement device 144 may further comprise controller 203 to allow an operator to silence aural notification means 143. Generally speaking, controller 203 may comprise a rocker switch, a toggle switch, a momentary contact switch, or a touch-screen switch. Other suitably equivalent manipulation means may be used. Further, when aural notification means 143 is disabled, system acknowledgement device 144 illuminates the at least one amber LED light 202.

In continuing to refer to FIG. 2, system reset means 145 may allow user to electronically signal rail sensor 120 to revert to an in-tolerance condition for first-preset tolerance 122. Electronic signaling means 123 removes signals to at least two red-LED lights 201 and aural notification means 143 when first-preset tolerance 122 of ultrasonic beam 121 is within limits. Further, aural notification means 143 comprises a disablement-means to temporarily disable aural notification means 143 and illuminate at least one amber LED light 202 when aural notification means 143 is disabled.

Figure 3A:
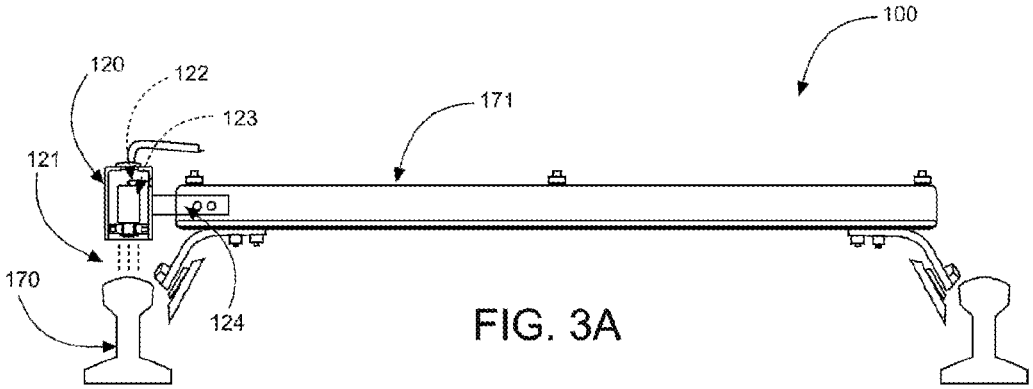
FIG. 3A shows a front perspective view of the derail alarm assembly according to an embodiment of the present invention of FIGS. 1-2.
Figure 3B:
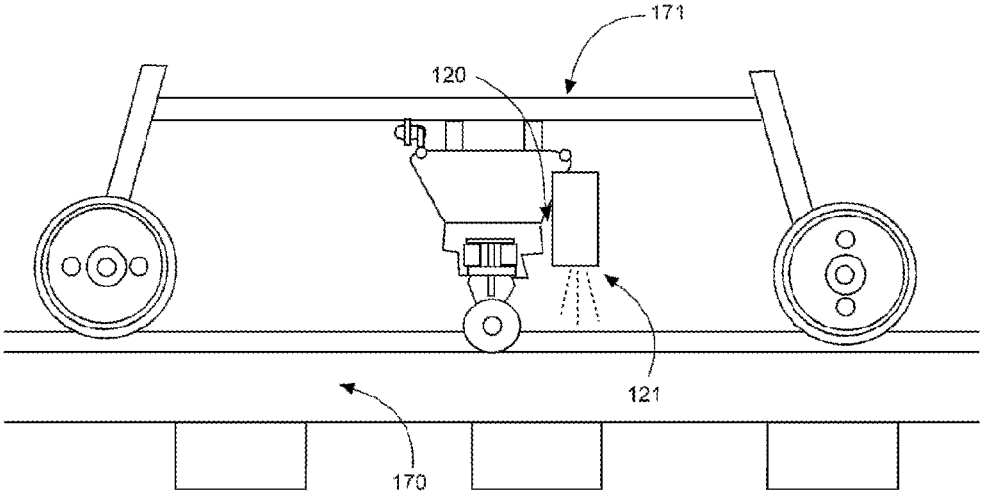
FIG. 3B shows a side perspective view illustrating the derail alarm assembly according as mounted to an embodiment of the present invention of FIGS. 1-2.

Referring now to FIGS. 3A and 3B, showing a perpective view of rail sensor 120. FIG. 3A shows a front perspective view of rail sensor 120 in an installed condition on tamping projector buggy 171 and in proximity to metal rail 170. Rail sensor 120 provides ultrasonic beam 121 and electronic signaling means 123. Rail sensor 120 comprises first-preset tolerance 122 of 4-8 inches for ultrasonic beam 121, and activates electronic signaling means 123 when first-preset tolerance 122 is exceeded. Further, rail sensor 120 may comprise mounting bracket 124, an attacher to affix rail sensor 120 to tamping projector buggy 171. Other mounting means may be employed, such as clips or welding.

In referring now to FIG. 3B showing a side perspective view of rail sensor 120 in an installed condition on tamping projector buggy 171 and in proximity to metal rail 170. Derail alarm system 100 ultrasonic beam 121 is preferably positioned perpendicular to rail sensor 120.

Figure 4:
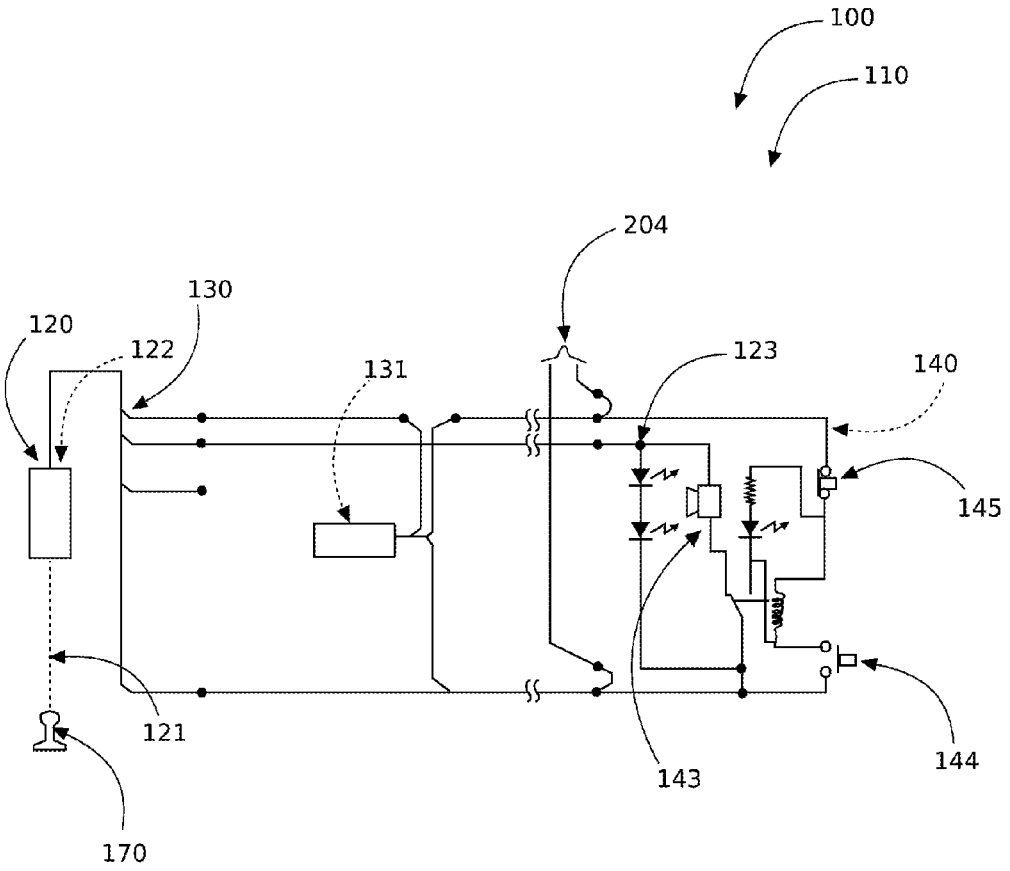
FIG. 4 is a schematic view illustrating the derail alarm system according to an embodiment of the present invention of FIGS. 1-3B.

Referring now to FIG. 4, which shows a schematic view of derail alarm system 100, comprising rail sensor 120, ultrasonic beam 121, and rail 170. Rail sensor 120 preferably comprises first-preset tolerance 122 of 4-8 inches for ultrasonic beam 121, and activates electronic signaling means 123 when first-preset tolerance 122 of 4 to 8 inches is exceeded. Cradle sensor 130 may comprise limit switch 131. Limit switch 131 may comprise a disabler to deactivate cradle sensor 130 and may disengage rail sensor 120. Further, control panel 140 may comprise system acknowledgement device 144, system reset means 145, and aural notification means 143. Generally speaking, derail alarm system 100, may comprise DC power 204 received from an external source.

Derail alarm system 100 may be sold as kit 440 comprising the following parts: at least one rail sensor 120 at least one cradle sensor 130; at least one control box 140; and at least one set of user instructions. Kit 440 has instructions such that functional relationships are detailed in relation to the structure of the invention (such that the invention can be used, maintained, or the like in a preferred manner). Derail alarm system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different mounting and indicating combinations, parts may be sold separately, etc., may be sufficient.

Figure 5:
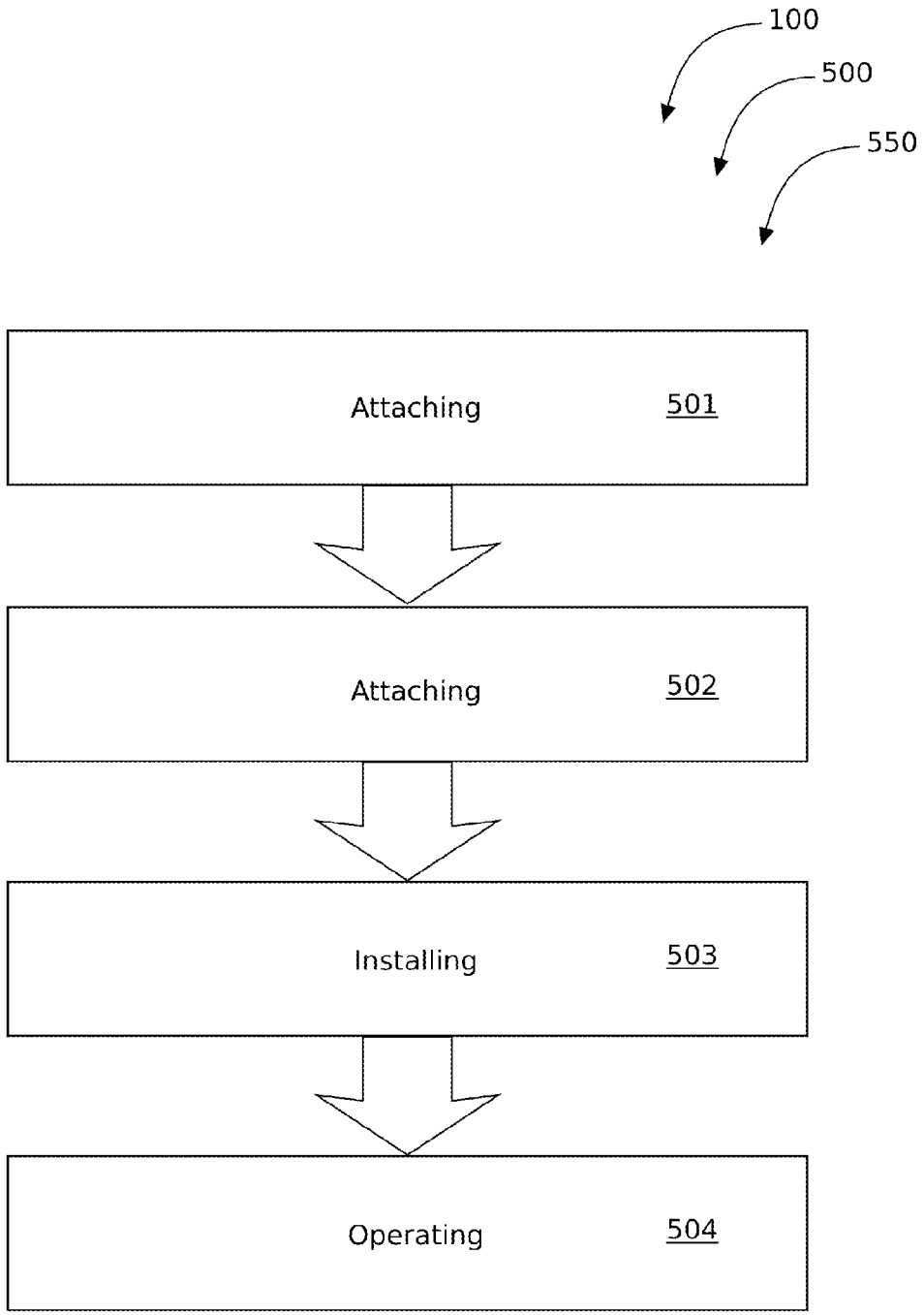
FIG. 5 is a flowchart illustrating a method of use for the derail alarm system according to an embodiment of the present invention of FIGS. 1-4.

Referring now to FIG. 5 showing flowchart 550 illustrating method of use 500 for derail alarm system 100 according to an embodiment of the present invention of FIGS. 1-4. As shown, method of use 500 may comprise the steps of: step one 501, attaching rail sensor 120; step two 502, attaching cradle sensor 130; step three 503, installing control box 140; and step four 504, operating derail alarm assembly 110.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A derail alarm system comprising:

a derail alarm assembly comprising;

a rail sensor structured and arranged to provide;

an ultrasonic beam;

a first-preset tolerance;

an electronic signaling means; and a mounting bracket;

a cradle sensor comprising;

a limit switch; and a control box comprising;

an electronic signal receiver;

an illuminated notification device;

an aural notification means;

a system acknowledgement device; and a system reset means;

wherein said derail alarm system comprises said derail alarm assembly;

wherein said derail alarm assembly comprises in structural combination said rail sensor, said cradle sensor, and said control box;

wherein said rail sensor provides said ultrasonic beam, said electronic signaling means, and said mounting bracket;

wherein said rail sensor comprises first-preset tolerance;

wherein said mounting bracket comprises an attacher to affix said rail sensor to a tamping projector buggy;

wherein said cradle sensor comprises a limit switch;

wherein said limit switch comprises a disabler to deactivate said cradle sensor when said tamping projector buggy is raised and stored in a travel position;

wherein said control box comprises said electronic signal receiver, said illuminated notification device, said aural notification means, said system acknowledgement device, and said system reset means;

wherein said system reset means comprises an activator to allow an operator to electronically signal said rail sensor to change to an in-tolerance condition for said first-preset tolerance;

wherein said system acknowledgement device comprises said activator to allow said operator to silence said aural notification means; and wherein said derail alarm assembly provides an electronic signal to said illuminated notification device and said aural notification means when said first-preset tolerance of said rail sensor is exceeded to notify of a derailment of the tamping projector buggy.

2. The derail alarm system of claim 1 wherein said ultrasonic beam is positioned perpendicular to said rail sensor.

3. The derail alarm system of claim 1 wherein said preset tolerances comprise a first-preset tolerance of 4-8 inches for said ultrasonic beam.

4. The derail alarm system of claim 1 wherein said illuminated notification device comprises at least three LED lights.

5. The derail alarm system of claim 4 wherein said at least three LED lights comprises at least two red-LED lights.

6. The derail alarm system of claim 4 wherein said at least three LED lights comprises at least one amber-LED light.

7. The derail alarm system of claim 3 wherein said electronic signaling means illuminates said at least two red-LED lights when said first-preset tolerance of said ultrasonic beam is exceeded.

8. The derail alarm system of claim 1 wherein said electronic signaling means activates said aural notification means when said first-preset tolerance of said ultrasonic beam is exceeded.

9. The derail alarm system of claim 8 wherein said aural notification means comprises a constant tone.

10. The derail alarm system of claim 8 wherein said aural notification means comprises a variable tone.

11. The derail alarm system of claim 1 wherein said aural notification means comprises at least 95 dB.

12. The derail alarm system of claim 7 wherein said electronic signaling means removes signals to said at least two red-LED lights and said aural notification means when said first-preset tolerance of said ultrasonic beam is within limits.

13. The derail alarm system of claim 1 wherein said limit switch of said cradle sensor comprises a means to disengage said rail sensor when said limit switch is activated.

14. The derail alarm system of claim 1 wherein said limit switch of said cradle sensor comprises said disabler to deactivate said cradle sensor when said tamping projector buggy is raised and stored in a travel position for an extended duration.

15. The derail alarm system of claim 1 wherein said aural notification means comprises a disablement-means to temporarily disable said aural notification means.

16. The derail alarm system of claim 1 wherein said aural notification means illuminates said at least one amber LED light when said aural notification means is disabled.

17. A derail alarm system comprising:

a rail sensor, a cradle sensor, and a control box, said rail sensor structured and arranged to provide;

an ultrasonic beam;

a first-preset tolerance;

electronic signaling means;

a mounting bracket;

a cradle sensor comprising;

a limit switch; and a control box comprising;

an electronic signal receiver;

an illuminated notification device;

an aural notification means;

a system reset means; and system acknowledgement device;

wherein said derail alarm system comprises said derail alarm assembly;

wherein said derail alarm assembly comprises in structural combination, said rail sensor, said cradle sensor, and said control box;

wherein said rail sensor provides said ultrasonic beam, said electronic signaling means, and said mounting bracket;

wherein said rail sensor comprises a first-preset tolerance;

wherein said mounting bracket comprises an attacher to affix said rail sensor to a tamping projector buggy;

wherein said cradle sensor comprises a limit switch;

wherein said limit switch comprises a disabler to deactivate said cradle sensor when said tamping projector buggy is raised and stored in a travel position;

wherein said control box comprises said electronic signal receiver, said illuminated notification device, said aural notification means, said system acknowledgement device, and said system reset means;

wherein said system reset means comprises a controller to allow an operator to electronically signal said rail sensor to change to an in-tolerance condition for said first-preset tolerance;

wherein said system acknowledgement device comprises a controller to allow an operator to silence said aural notification means;

wherein said ultrasonic beam is positioned perpendicular to said rail sensor;

wherein said rail sensor comprises a first-preset tolerance of 4-8 inches for said ultrasonic beam;

wherein said illuminated notification device comprises at least three LED lights;

wherein said at least three LED lights comprises at least two red-LED lights;

wherein said at least three LED lights comprises at least one amber-LED light;

wherein said electronic signaling means illuminates said at least two red-LED lights when said first-preset tolerance of said ultrasonic beam is exceeded;

wherein said electronic signaling means activates said aural notification means when said first-preset tolerance of said ultrasonic beam is exceeded;

wherein said aural notification means comprises a variable tone;

wherein said aural notification means comprises at least 95 dB;

wherein said electronic signaling means removes signals to said at least two red-LED lights and said aural notification means when said first-preset tolerance of said ultrasonic beam is within limits;

wherein said limit switch of said cradle sensor comprises a means to disengage said rail sensor when said limit switch is activated;

wherein said aural notification means comprises a disablement-means to temporarily disable said aural notification means; and wherein said system acknowledgement device illuminates said at least one amber LED light when said aural notification means is disabled; and wherein said derail alarm provides said electronic signaling means to said illuminated notification device and said aural notification means when said first-preset tolerance of said rail sensor is exceeded to notify of a derailment of the tamping projector buggy.

* * * * *